United States Patent [19]

Medley

[11] 4,399,771

[45] Aug. 23, 1983

[54] PET DOOR

[76] Inventor: Douglas G. Medley, Galiano Island, British Columbia, Canada, V0N 1P0

[21] Appl. No.: 293,427

[22] Filed: Aug. 17, 1981

[51] Int. Cl.[3] ..... E06B 3/38

[52] U.S. Cl. ..... 119/19; 49/41

[58] Field of Search ..... 119/15, 19; 49/41, 169, 49/385

[56] References Cited

U.S. PATENT DOCUMENTS

| | | | |
|---|---|---|---|
| 624,712 | 5/1899 | Walker | 49/169 |
| 858,643 | 7/1907 | Bennington et al. | 119/19 |
| 2,153,673 | 4/1939 | Nidever | 119/15 X |
| 3,367,308 | 2/1968 | Quattrone et al. | 119/15 |
| 4,216,743 | 8/1980 | Cohen | 119/19 |

*Primary Examiner*—Robert P. Swiatek

*Attorney, Agent, or Firm*—Beveridge, DeGrandi and Kline

[57] ABSTRACT

A pet door assembly for mounting over an opening includes a box containing a pivot arranged to be positioned beside the opening and such as to extend perpendicularly to the plane of the opening, and a door mounted on the pivot so as to be movable in its own plane between positions in which it opens and closes the opening. A rotary electric drive device such as a rotary solenoid are provided for swivelling the door between the open and closed positions, and a sensing device is provided which is operable by a pet for causing actuation of the drive device to open the door. Preferably, a tunnel is provided by tubular members which are separated by a gap in which the door can move, and weather stripping may be provided between the door and the adjacent ends of the tunnel members. For better insulation, the door may comprise 2 spaced apart planar members which are mounted to move together.

4 Claims, 6 Drawing Figures

PET DOOR

Figure 1:
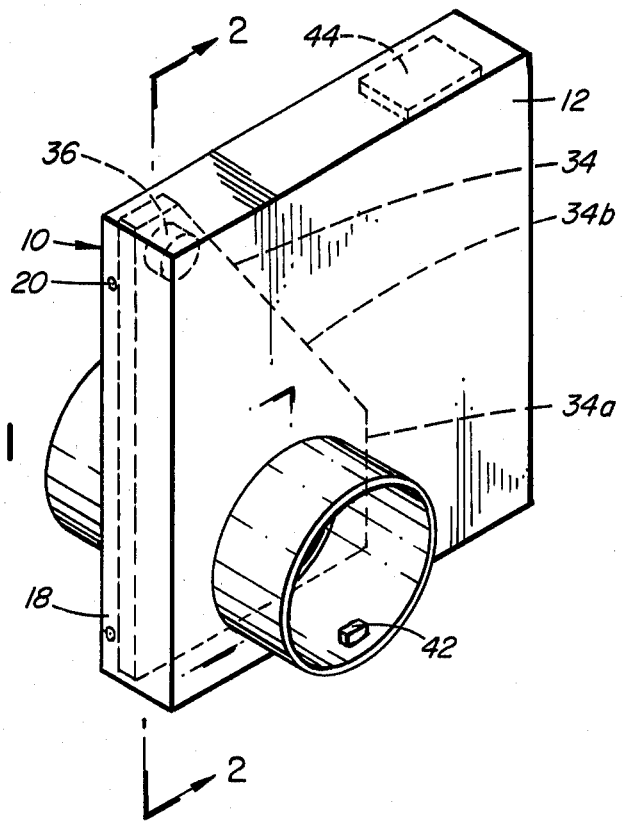

The present invention provides a pet door assembly of the type which can be fixed over an opening in a door or wall, to allow access by a pet. The pet door is preferably arranged to be operated automatically when a pet equipped with a certain device, for example a magnet, attempts to enter through the door.

One pet door of this general type is already known according to U.S. Pat. No. 4,022,263 which issued on May 10, 1977 to Beckett et al. In accordance with this patent a swinging door is provided which is hinged along its top so that the pivotal axis of the door runs along the top of this and is co-planar with the opening.

Canadian Pat. No. 1,071,662 which issued Feb. 12, 1980 to Gordon A. Breakenridge shows an electrically operated pet door assembly in which the door slides with rectilinear motion.

The present invention provides a pet door assembly which makes use of a door having a different kind of movement from the doors described in the above patents. In my pet door assembly the door itself is pivotable about a pivot which extends perpendicular to the door and to the plane of the opening, so that the door moves or swivels in its own plane. This gives particular advantages in providing for ease of construction, and in providing a door which resists unauthorized entry and which can easily be arranged to give good weather sealing and heat insulation.

According to one aspect of my invention, a pet door assembly for mounting over an opening comprises pivot means arranged to be positioned adjacent the opening and to extend generally perpendicularly to the plane of the opening, and a door mounted on the pivot means so as to be movable in its own plane between opened and closed positions. Electric drive means are provided for moving the door between its open and closed positions, and means are provided which are operable by a pet for causing actuation of the drive means to open the door.

The drive means for moving the door is preferably a rotary solenoid. This gives an arrangement which is very simple mechanically, as compared to a rectilinearly sliding door.

The door and solenoid will normally be contained within a rectangular enclosure, with the pivot means being adjacent one corner of the enclosure. The enclosure has apertures which match the opening and which are positioned in a corner adjacent to that occupied by the pivot means, and the door is mounted so that it can swing to the corner remote from that of the opening, in other words it moves generally diagonally across the enclosure so that the dimensions of the enclosure are minimized relative to the size of the apertures.

Where good insulation is required, a double door, i.e. a door having two spaced apart planar portions, can easily be provided, these portions swinging together and not requiring any substantial additional complexity in the construction. Each outer surface of the door, whether double or single, is flat and can be arranged to pass closely adjacent to, and to seal against, the end of a tubular member extending out of apertures in the front and rear of the enclosure, these tubular members together forming a tunnel for the pet. Weather stripping may be provided on the inner ends of these tunnel members to contact the outer faces of the door when closed so as to minimize heat leakage. The outer ends of the tunnel may carry sensing devices which can automatically sense a pet entering the tunnel to open the door, and it is easily arranged for these sensing means to operate both when the pet is entering and when it is leaving. To prevent a pet from leaving the house, the inner sensing circuit may be de-energized.

Figure 2:
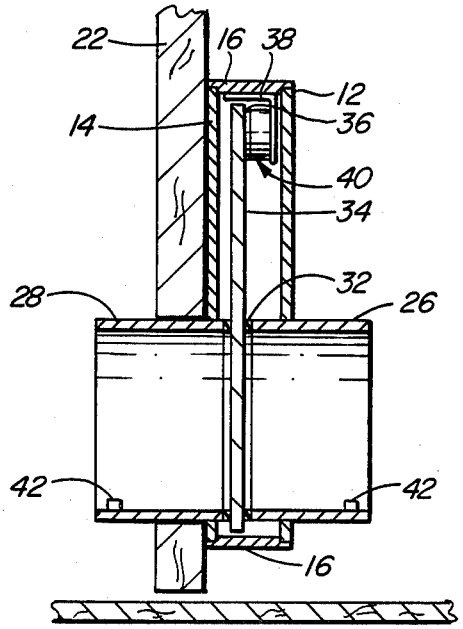
Figure 3:
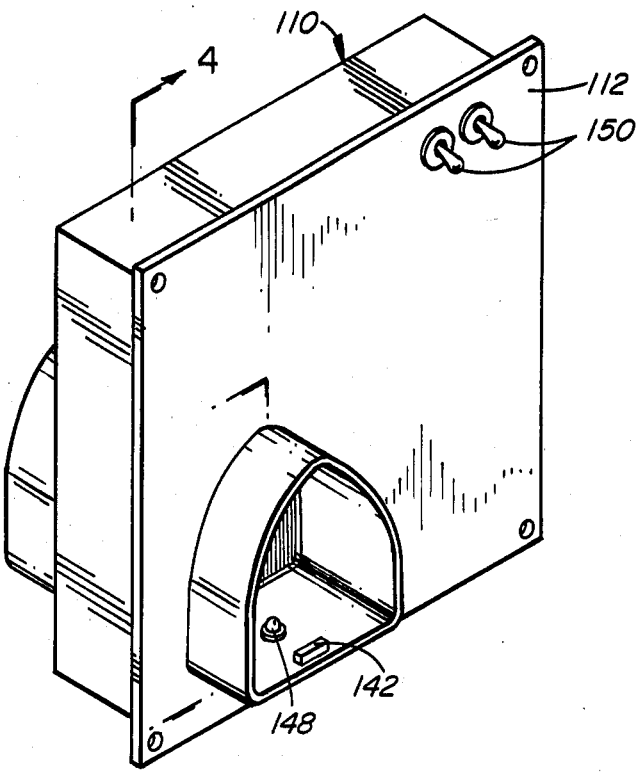
Figure 4:
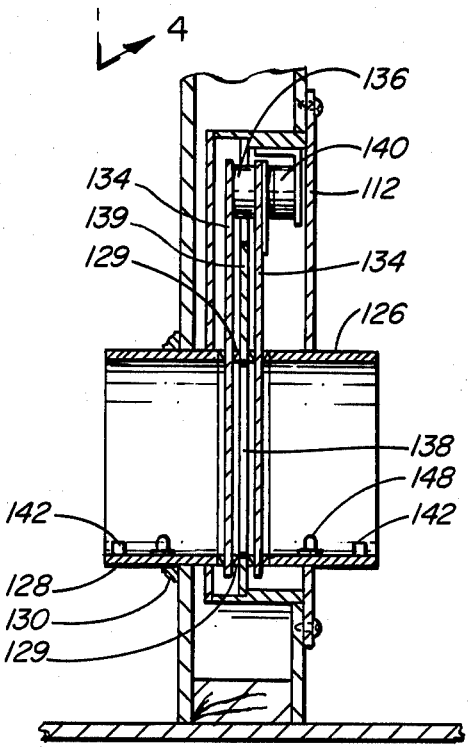
Figure 6:
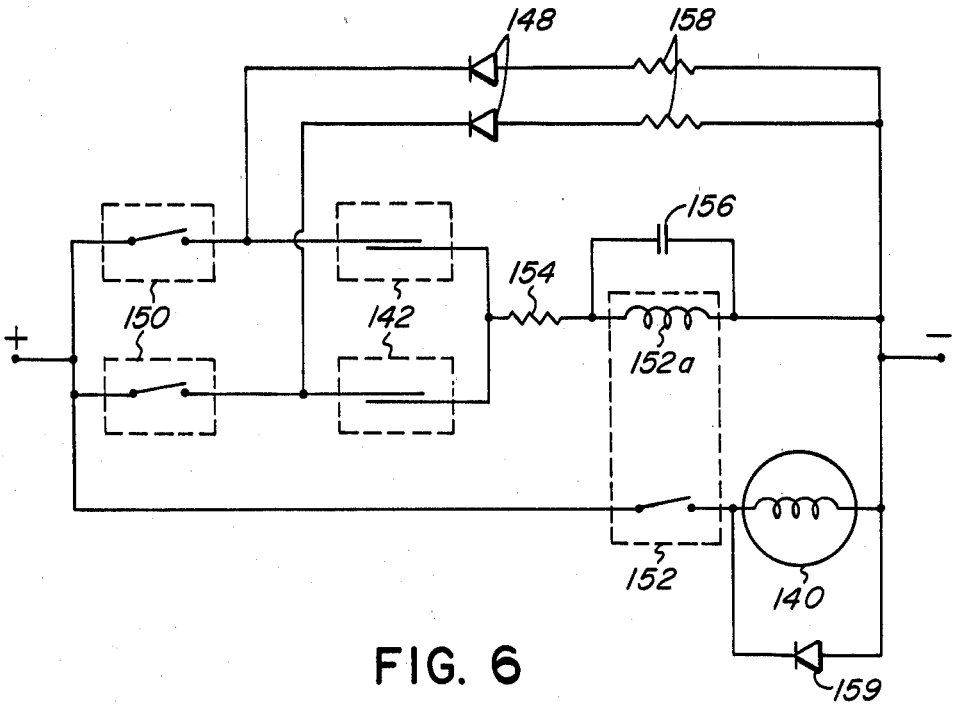
Figure 5:
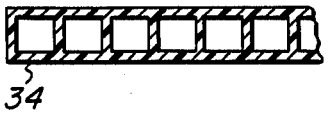

The invention will be further described with reference to the accompanying drawings, in which:

FIG. 1 shows a pet door assembly in perspective,

FIG. 2 shows a sectional elevation of the pet door assembly of FIG. 1 when mounted on a door, FIG. 3 shows a perspective view of a second embodiment of pet door assembly, FIG. 4 of the drawings shows a sectional elevation of this second embodiment taken on lines 4—4 of FIG. 3 when mounted in a wall, FIG. 5 is a cross-sectional view through a portion of a door panel, and FIG. 6, is an electrical circuit for the pet door.

FIGS. 1 and 2 show a small and simple version of the pet door assembly.

The assembly includes a flat box 10 having front and rear walls 12 and 14, top and bottom walls 16, and sidewalls 18. The sidewalls 18 have diagonally drilled and countersunk holes 20 allowing the assembly to be screwed onto a door such as door 22 shown in FIG. 2. The box is rectangular having a height about 10% greater than the width.

The front and rear walls 12 and 14 are each provided with a circular aperture adjacent one corner, and projecting through these apertures are cylindrical tunnel members 26 and 28 formed of plastics, and which together form a tunnel for the pet. The rear tunnel member 28 passes through an opening provided for it in the door 22.

The members 26 and 28 have adjacent ends which are perpendicular to the axis of the tunnel and which are faced with a resilient, weather strip material 32 of the foam rubber type. The end faces of the members provided by this resilient material between them define a narrow, parallel sided gap in which a door 34 can move. In this embodiment, the door is formed from an extruded panel of translucent Lexan TM plastic, which is both light and strong, and which has substantially flat faces and an air gap in between these faces. A cross-sectional view of a portion of this panel is shown in FIG. 5. The shape of the door is indicated in FIG. 1, and it will be seen that this includes a door section proper **34*a* which is of sufficient size to completely block the passageway between the two tunnel members, and a triangularly shaped connecting portion 34*b* which connects the main portion to a pivot 36. This pivot is part of a rotary solenoid 40 mounted on bracket 38 attached to the top wall 16 of the box, and the pivot extends parallel to the axis of the tunnel and perpendicularly to the opening in the door. The pivot is thus arranged so that the door can swivel in its own plane from the position shown in which the tunnel is closed, to an open position in which the door has been rotated through about 45 degrees and in which the main portion 34*a* of the door occupies a position diagonally displaced from the tunnel in the opposite corner of the box. The way in which the main operative portion 34*a*** of the door moves from one corner to the opposite corner of the box minimizes the dimensions of the box relative to the size of the tunnel.

The energization of rotary solenoid 40 moves the door to the open position; when this is deactivated the door returns to the closed position by gravity, although a spring on the solenoid may also be used to ensure proper closing.

The rotary solenoid may be of the type made by Ledex Inc. of Vandalia, Ohio, U.S.A., under Model No. P/N 810-612-526. This is connected in circuit with a power source of 12 volts, and is also in circuit with two magnetic reed switch sensors 42 which are mounted inside the bottom of the outer ends of the tunnel members. The devices 42 are capable of being actuated by a small plastic encased magnet arranged to be suspended from the collar of a dog or cat. With a little training, when the animal wishes to enter through the pet door it places its head in the tunnel so that the magnet operates the sensor, and this closes the circuit and opens the door for a predetermined time interval. As will be described hereinafter with reference to the second embodiment, the time delay feature can be provided by a capacitor in the circuit. Electrical items including the condenser are carried on a junction board 44 indicated in FIG. 1.

The provision of foam rubber weather stripping 32, or the like, on the inner ends of the tunnel members has a dual purpose since this not only minimizes drafts through the pet door assembly, but also makes it difficult for anyone to open the pet door by hand, since any pressure applied to the pet door tends to cause this to bind on the weather stripping. The door is thus very difficult to open by hand and cannot be opened by an animal not equipped with the magnet actuator.

The second embodiment of pet door assembly as shown in FIGS. 3 to 4 and 6 is larger than the first embodiment and has some additional features.

The box 110 of this embodiment has a front wall 112 the edges of which provide a mounting flange so that the whole box can be recessed within a cavity wall as shown in FIG. 4, the flanges of the front wall 112 being then screwed to the interior wall panel. The tunnel members 126 and 128, while being generally similar to the corresponding parts of the first embodiment, are shaped to have a flat bottom, vertical sidewalls, and sloping roof portions, to give an opening size which is a maximum consistent with the box fitting between wall studs on a 16 inch centre to centre spacing. A collar 130 is fitted around the outer tunnel member 128 and provides a good seal against the exterior wall of the house.

The arrangement of pivot 136 and rotary solenoid 140 in this embodiment is generally similar to that of the first embodiment, but here the door comprises two spaced apart flat planar members 134 which are mounted to rotate together on pivot 136. Each of these members is similar in shape and material to door 34 of the first embodiment. The outer surface of each of these door portions can seal against weather stripping provided on the inner ends of the tunnel members 126 and 128, again as in the first embodiment, but additional seals 129 are provided around an aperture 138 in a wall member 139 which may be of particle board or foam insulating board; aperture 138 matches the interior of the tunnel members in size and shape. Thus, additional sealing and insulation is provided. However, since the two door portions are rigidly attached to each other adjacent the pivot, this double door feature adds relatively little to the complexity of the assembly. The weight of the double door is such that no spring is required for closing this.

The tunnel members carry sensing devices 142 similar to those of the first embodiment, and additionally carry small indicating lights 148 just inwardly of the sensors. Also, the front wall of the box 112 is provided with two switches 150 which respectively control access through the pet door from the inside or the outside.

The circuit diagram shown in FIG. 6 represents a circuit suitable for the second embodiment when operated by a 12 volt source. The 12 volt source may be a battery, or a small tranformer adapter unit which plugs into a wall outlet.

As will be seen from FIG. 6, the rotary solenoid 140 is connected to the 12 volt supply via a relay switch 152. The coil **152*a* of the relay is connected to the supply via a resistor 154 and via two parallel sub-circuits each including one of the switch sensors 142 and one of the manual switches 150. A time delay capacitor 156 is connected across the relay coil. The indicating lights 148 are light emitting diodes which are connected to the supply in series with a respective switch 150 and a resistor 158**.

An arc suppressor 159, which can be a diode, protects the rotary solenoid from arcing caused by voltage spikes when the inductive load is disconnected.

If one of the manual switches 150 is closed then this energizes one side of the door assembly so that a pet can pass through the door from that side. The indicating light 148 shows that access from that side of the door is possible, and the pet soon learns to recognize this.

When the pet approaches the appropriate side of the door, the magnet worn on the collar operates the reed switch sensor 142 and completes the circuit through the relay coil **152*a*, closing the relay switch and causing the rotary solenoid to open the door. The capacitor 156** across the relay coil charges up instantaneously when the switch is closed, and after the switch sensor opens (as happens as soon as the pet starts to pass through the door) the capacitor maintains current in the relay coil for about 3 seconds to hold the door open for this time interval. This time interval is found to be suitable for most animals and prevents a pet from being followed through the door by a stray. The resistor between the reed switch and relay coil keeps the reed switch contacts from being damaged by the current surge produced with initial closing of the contacts.

In the embodiments described, the door may close merely under the influence of gravity or a spring may be used to assist in closing. It may be desirable, however, to place the pivot for the door on the lower corner of the box opposite the tunnel, in which case the force provided by gravity for closing of the door will be more effective and a spring will not be required. This gives a shape of pet door which is of greater width than height. The two upper corners may be diagonally eliminated by a proportion of one third the height and length.

Although the binding effect provided by the weather stripping on the door is fairly effective in preventing unauthorized entry, such entry can be more positively prevented by providing an electrically operated latch to hold the door in place. This latch would be operated by a pull solenoid connected in parallel with the rotary solenoid which operates the door. Such a latch may be mounted beside the rotary solenoid and may have a shaft which projects into a hole in a latching plate sandwiched between the the rotary solenoid armature and the door when the latch solenoid is de-energized.

Instead of the magnetic reed switch sensor as described, a remote sensing device may be used. Such systems may make use of a Hall field effect transistor, a capacitance-inductance sympathetic resonance, a radio transmitter, or an infra-red system. With such a remote sensor, the need for a tunnel protrusion could be eliminated.

Instead of the 12 volt system as described, a mains supply system may be used, and this would give some advantage in allowing a more powerful solenoid to be used. A more powerful solenoid could give better sealing with a tighter arrangement of weather stripping, and could also be used to move a heavier door, for example a door having a triple layer of plastic, or a large door for bigger animals.

I claim:

1. A pet door assembly for mounting over an opening, comprising:

a generally rectangular box having front and rear walls, said walls having aligned apertures, two tubular members together defining a tunnel, each member extending through one of said apertures, said members having adjacent end faces which define a parallel sided gap, pivot means positioned within said box but outside said tunnel, and extending generally parallel to the tunnel axis, a planar door mounted on said pivot means so as to be movable in its own plane within said gap between a closed position in which an operable portion thereof extends fully across said gap and an open position in which a pet can pass through the tunnel, the relationship of the door to the box being such that the door rotates through about 45° in moving from the closed to the open position while the operative portion thereof moves from one corner to the diagonally opposite corner of the box, electric rotary drive means for moving the door between the open and closed positions, and means carried adjacent an outer end of the tunnel and operable by a pet for energizing said drive means to open the door.

2. A pet door according to claim 1 wherein said door includes two planar, spaced apart portions each having an outwardly facing flat surface which, in the closed position the door, lies closely adjacent one of said adjacent end faces of the tubular members to form a substantial seal therewith.

3. A pet door assembly for mounting over an opening, comprising:

pivot means arranged to be positioned adjacent said opening and arranged to extend generally perpendicularly to the plane of the opening, a door mounted on said pivot means so as to be movable in its own plane between positions in which it respectively opens and closes the opening, said door including two planar, spaced apart portions each having an outwardly facing flat surface which, in the closed position of the door, lies closely adjacent to the end surface of a tunnel member extending outwardly from the door, said tunnel members together forming a tunnel providing a sealed passage through the opening, electric drive means for moving said door between the open and closed positions, and means carried by said tunnel and operable by a pet for causing actuation of said drive means to open the door, said means including a sensing device which is such as to sense automatically a pet entering the tunnel and to cause opening of the door, by energizing said drive means, said sensing device being connected to said electric drive means by an electric circuit including a capacitor which is arranged to maintain energization of the drive means for a period of time after said sensing device has been actuated, whereby a pet may have time to pass through the tunnel before the door closes.

4. A pet door according to claim 3, wherein said electric drive means is a rotary solenoid.

* * * * *